United States Patent [19]

Black et al.

[11] 4,224,712

[45] Sep. 30, 1980

[54] TOWEL AND METHOD

[75] Inventors: Henry C. Black; Ella J. Black, both of Cleveland, Tex.

[73] Assignee: Sweat Buddy, Inc., Houston, Tex.

[21] Appl. No.: 907,759

[22] Filed: May 19, 1978

[51] Int. Cl.[3] ..... A47K 10/02

[52] U.S. Cl. ..... 15/209 R; 2/279; 112/427; 112/441; D6/265

[58] Field of Search ..... 2/279; 15/208, 209 R, 15/210 R, 214, 218; 24/3 R, 3 M, 7; 112/427, 440, 441; 139/396; 428/181; D2/395, 400; D6/265

[56] References Cited

U.S. PATENT DOCUMENTS

| | | | |
|---|---|---|---|
| D. 189,286 | 11/1960 | Belleni | D6/265 |
| D. 242,105 | 11/1976 | Rohrs | D6/265 |
| 2,033,621 | 3/1936 | Freedman | 428/181 X |
| 2,754,532 | 7/1956 | Kanehl et al. | D6/265 X |
| 2,947,993 | 8/1960 | Donath | 112/427 X |
| 3,760,461 | 9/1973 | Wright | 24/7 |

FOREIGN PATENT DOCUMENTS

| | | | |
|---|---|---|---|
| 1947401 | 3/1971 | Fed. Rep. of Germany | 112/427 |
| 1564952 | 3/1969 | France | 2/279 |

*Primary Examiner*—Edward L. Roberts

[57] ABSTRACT

Disclosed are a towel adapted to be worn by the user and a method of making such towel. A sheet of flexible material is cut to form a main body member including opposite end portions and opposite side edges extending generally transversely to the end portions. At least one tab member is also formed, depending from one of the end portions. The sheet material of the main body member is folded upon itself to form an uninterrupted forward face and to position each of the side edges generally adjacent to and rearwardly of a respective one of the lateral extremities of said forward face. The folded sheet material is secured upon itself adjacent the end portion from which the tab member depends.

14 Claims, 8 Drawing Figures

TOWEL AND METHOD

BACKGROUND OF THE INVENTION

1. Field of the Invention

The present invention pertains to a towel which may be worn on the person of the user. For example, athletes frequently find it desirable, and sometimes necessary, to have a towel handy during sporting events. In particular, there is a need for such towels in football, e.g. for use by the quarterback and center who must keep their hands relatively dry in order to maintain a proper grip on the ball. However, this need is by no means exclusive to football players, and many other athletes such as tennis players, basketball players, etc. find it useful to keep a towel in a convenient place during games.

2. Description of the Prior Art

In the past, it has been conventional for football players who require the use of a towel during play to keep an ordinary towel tucked under the waistband of their trousers. However, this arrangement has been far from satisfactory. It is literally impossible for players to keep these towels neatly arranged, and they are of necessity tucked into the players' uniforms in a haphazard manner, thereby detracting from the teams' appearance and getting in the players' way. Furthermore, the towels become dislodged during play, and the players must constantly be rearranging and/or replacing them. Also, when the towels become completely dislodged, they are trampled on the playing field and may thereby become so wet and dirty that they are rendered virtually useless. Indeed, the use of an ordinary towel in this manner is so inconvenient that the linemen who do not frequently handle the ball typically forego the wearing of towels altogether and simply wait until they are at the sidelines to use towels which are kept there. This latter approach to also frequently taken by the players of other sports such as tennis and basektball since it is too troublesome for the players to attempt to keep a towel in place on their person during an actual play.

Several attempts have been made to design towels which would be more convenient for wearing by an athlete during actual play of a sport or game. For example, some of these towels include loops, hooks and the like by which the towels may be more firmly secured to the wearer's garments. However, such attachment means, while suitable for one sport, may be unsuitable for another. For example, a towel which is positively secured at the wearer's waist, as by a belt loop, cannot be readily used to wipe the player's face or neck. Where the attachment means comprises some type of hardware, such as a metal hook, it may be suitable for a sport such as bowling or golf, but would be unsafe for use in contact sports. Other attachment means, such as self-adhering fabrics, while perfectly safe, do not secure the towel firmly enough for certain sports.

Another disadvantage with many prior art towels is that, while they may be provided with more sophisticated means of securing the towel on the user's person, they hang in loose, irregular folds so that their appearance is little better than that of a conventional towel which is merely tucked into or under the garment. On the other hand, where the towel is secured in a neatly folded configuration, some effort is required to open the towel out for use, and this may be a considerable inconvenience in a fast moving game such as football or basketball. Indeed, this latter inconvenience may be experienced even where the towel is not folded but merely hangs loosely.

SUMMARY OF THE INVENTION

The present invention provides a towel which may be conveniently worn by active athletes as well as others. The towel may be secured on the user's person so that it remains firmly in place and resists dislodging during active play and yet is quickly and easily removable when desired. Furthermore, the towel is secured in a folded configuration such that it may be quickly and easily opened for use, but will automatically drop back into a flat, neatly folded configuration when released.

In particular, the towel of the present invention includes a main body member of fabric or other sheet material having a pair of opposite end portions and a pair of opposite edges extending generally transversely thereto.

The material of the main body member is folded upon itself to form an uninterrupted forward face and to position each of the side edges generally adjacent to and rearwardly of a respective one of the lateral extremities of the forward face. The material is further secured upon itself in this folded configuration adjacent one of its end portions. A tab assembly, which may be formed of one or more tab members, integrally depends from the same end portion of the main body member at which the material is secured upon itself. The tab assembly is preferably formed of the same or similar fabric or sheet material as that of the main body member.

In preferred embodiments of the invention, the material of the main body member is folded and secured upon itself in the form of a single box pleat. This configuration provides the aforementioned uninterrupted forward face as well as a flat folded configuration whereby the towel will lie against the player's body and out of his way. The flat configuration and uninterrupted forward face also presents a particularly neat appearance, which can be further enhanced by the application of a suitable design or logo to said uninterrupted face. As mentioned above, the player may open out and use the towel and, when he releases it, it will automatically re-assume its folded configuration so that the design or logo is always attractively displayed when the player is not actually using the towel.

The towel may be secured upon the user's person by tucking the aforementioned tab assembly under the belt or the waistband of the user's trousers. As mentioned above, the tab assembly may be comprised of a plurality of tab members, and if so, such tab members are secured together in overlying relation. Thus, the tab assembly is stiffened or reinforced so that it effectively resists becoming dislodged during active play. In one preferred embodiment of the invention, the overlying tab members are secured together in longitudinally spaced locations so that a passageway is formed between the tab members intermediate the secured locations. This passageway may be used as a belt loop to provide an alternative means of securing the towel on the person of the user.

As previously noted, the manner of folding the main body member of the towel serves to place the side edges thereof generally adjacent to the lateral extremities of the uninterrupted forward face. Thus, the side edges are within easy reach of the user so that the towel may be quickly and easily opened out, even during a fast moving sport such as football or basketball. This effect may be further enhanced by permitting the side edges, while still generally adjacent the lateral extremities of the forward face, to extend laterally beyond such extremities. When the towel is configured in this manner, a border trim is preferably applied along the entire outer periphery of the folded towel. Such border then serves multiple functions including securing the main body member and tab assembly in the desired configuration, preventing ravelling of the raw edges of the material from which the towel is formed, and enhancing the attractive appearance of the towel.

It will thus be apparent that the towel of the present invention substantially eliminates the numerous disadvantages involved in the use of the conventional towel discussed above. The present invention provides a welcome solution to athletes such as football quarterbacks and centers, who require a towel during play. Furthermore, other athletes such as football linemen, basketball players, tennis players, etc., who in the past have not worn towels on their persons, may now do so with the present invention without the inconveniences of prior art towels. Indeed, the towel of the present invention is so attractive in appearance that it may even be worn, for example, by sports fans, primarily as an ornament or accessory bearing an appropriate design or logo. Likewise, the towel may be advantageously used by other persons, such as restaurant employees, who have use for a towel in their work.

Accordingly, it is a principal object of the present invention to provide an improved towel which may be conveniently worn by the user.

It is another object of the invention to provide a towel which may be quickly and easily opened for use, but will automatically resume a flat, neatly folded configuration when released.

Still another object of the present invention is to provide a towel having a tab assembly by which the towel may be firmly yet removably secured on the user's person.

A further object of the present invention is to provide a towel which is both functional and attractive in appearance.

Yet another object of the present invention is to provide a method of forming such a towel.

Other objects, features, and advantages of the present invention will be made apparent by the following description of the preferred embodiments, the drawing and the claims.

DESCRIPTION OF THE PREFERRED EMBODIMENTS

Figure 1:
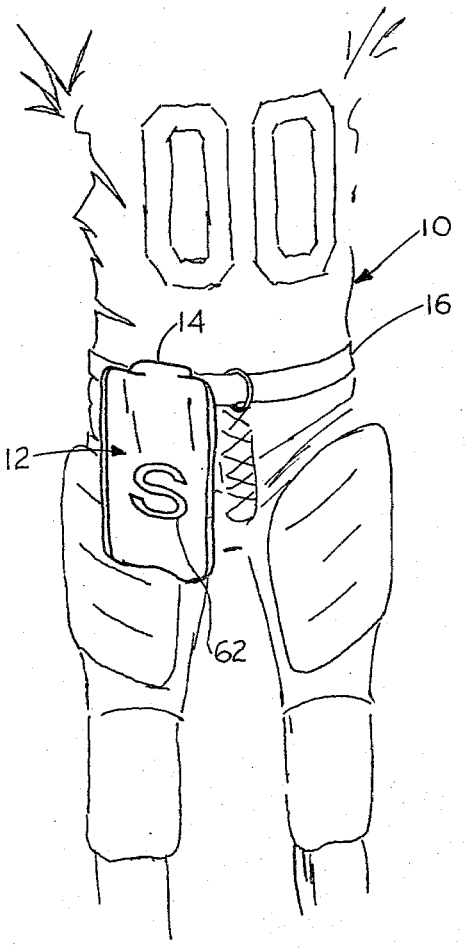
FIG. 1 is a partial front view of a football player wearing a towel according to the invention.
Figure 3:
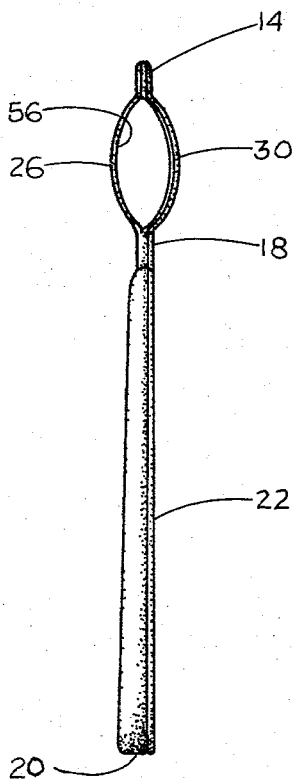
FIG. 3 is a side elevational view of the towel of FIG. 2 with the tab assembly raised and the belt loop open.

Referring now to the drawing, FIG. 1 illustrates a towel in accord with the present invention secured on the person of a football player 10. The towel includes a main body member 12 which extends downwardly generally from the waist of the player 10, and a tab assembly 14 which extends from the upper end portion of main body 12 over the waistband 16 of the player's uniform and then downwardly behind the waistband 16 and the main body member 12 to secure the towel on the player's person. The towel of FIG. 1 is shown in greater detail in FIGS. 2–5. In those figures it can be seen that the main body member 12 includes a pair of opposite end edges, specifically an upper edge 18 and a lower edge 20, as well as opposite side edges 22 and 24 extending generally transversely to end edges 18 and 20. The construction of the towel of FIGS. 2–5 can best be understood by considering these figures in conjunction with FIGS. 7 and 8 which show steps in the formation of the towel.

Figure 7:
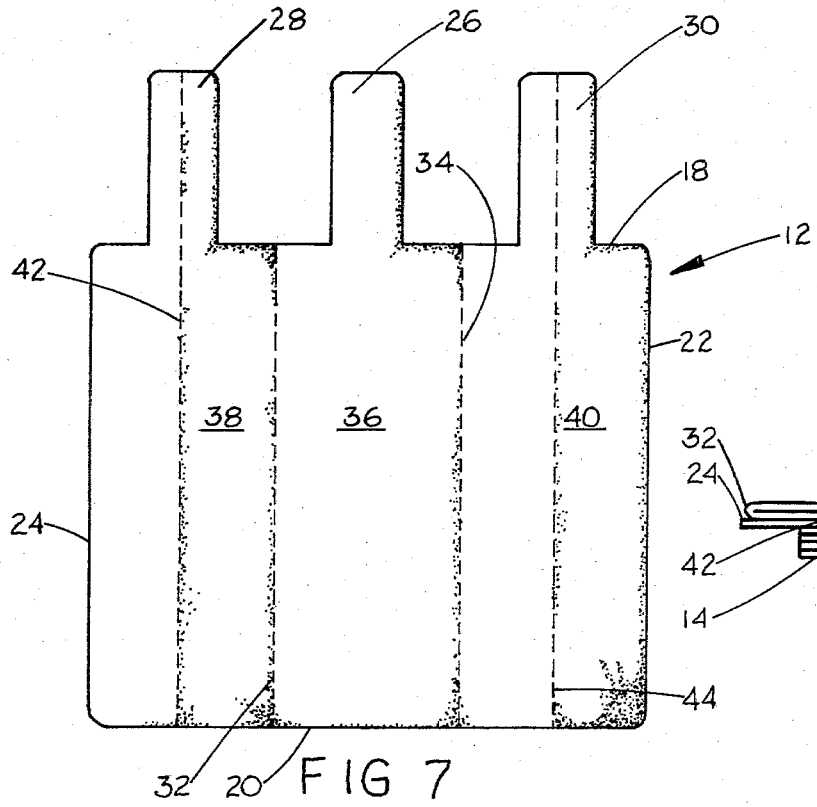
FIG. 7 is a plan view of a towel blank which may be used in forming towels according to either of the preceding embodiments.
Figure 8:
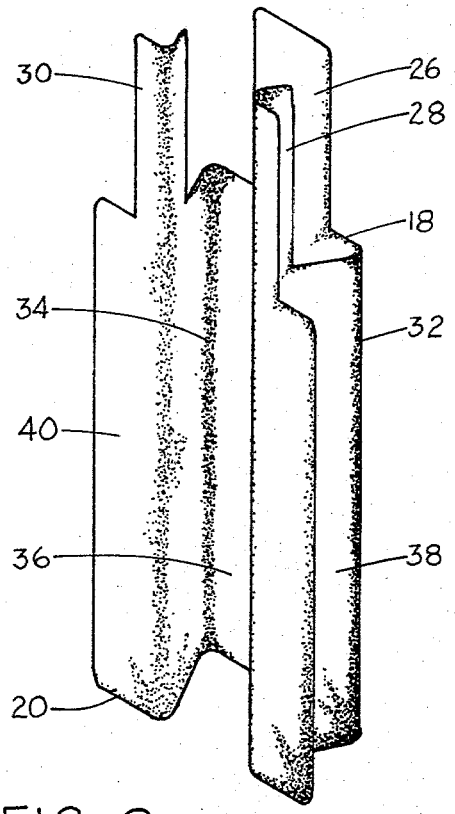
FIG. 8 is a perspective view illustrating the manner of folding the towel blank of FIG. 7.

In one preferred method of forming a towel according to the invention, a towel blank, shown in FIG. 7, is first cut from flexible sheet material, such as fabric, paper toweling, chamois, etc., depending upon the specific use to which the towel is to be put. The towel blank includes the main body member 12 as well as three tab members 26, 28 and 30, integrally depending from the upper edge 18 of the main body member 12. Main body member 12 is generally rectangular in configuration, but has rounded corner portions. The tab members 26, 28 and 30 are of substantial identical size and generally rectangular shape having rounded upper corners. Tab member 26 is located at the center of upper edge 18 of main body member 12. Tab member 28 is spaced along edge 18 from tab member 26, and is also spaced from side edge 24 by a distance slightly greater than one half the distance between tab members 26 and 28. Similarly, tab member 30 is spaced along edge 18 from tab member 26 in the opposite direction from tab member 28 but by an equal distance. Tab member 30 is further spaced from said edge 22 of main body member 12 by a distance substantially equal to the distance from side edge 24 to tab member 28.

Figure 2:
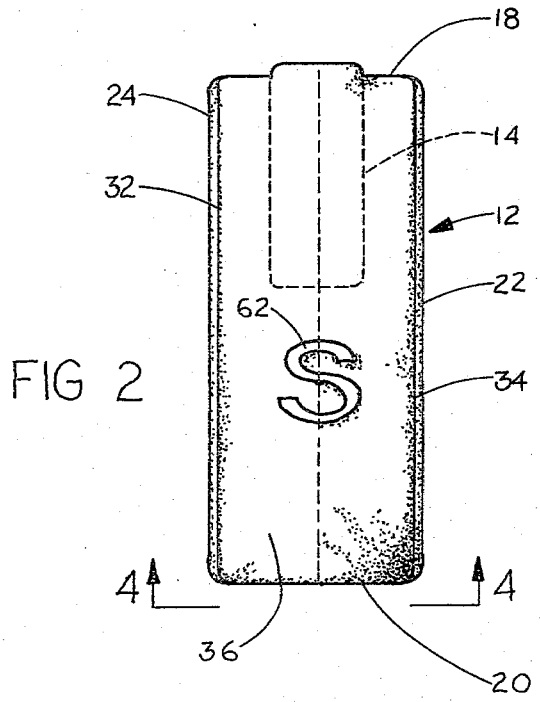
FIG. 2 is a front elevational view of a first embodiment of the invention with the tab assembly folded back behind the main body member, as it would be in use.
Figure 4:
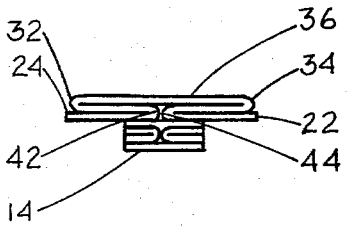
FIG. 4 is a bottom plan view taken on line 4—4 of FIG. 2.

To form the towel blank of FIG. 7 into a towel according to the present invention, the towel blank is folded upon itself in the form of a single box pleat and secured upon itself. For purposes of this description, the towel blank may be considered to be divided into three contiguous sections by longitudinally extending lines 32 and 34, each located half way between the central tab member 26 and a respective one of the other tab members 28 and 30. Specifically, the towel blank, as well as the finished towel, may be considered to have a central section 36 and side sections 38 and 40. To form the aforementioned box pleat, side section 38 is folded upon itself along a longitudinally extending line 42, coincident with the centerline of tab member 28, by bringing the respective side edge 24 forward. Likewise, side section 40 is folded upon itself along a line 44 coincident with the longitudinal centerline of its tab member 30 by bringing its respective side edge 22 forward. The side sections 38 and 40 are folded rearwardly along lines 32 and 34 placing fold lines 42 and 44 adjacent the longitudinal centerline of central section 36. By such folding, an uninterrupted forward face is formed of the portion of main body member 12 included within central section 36 of the towel blank, the lateral extremities of such forward face being defined by the fold lines 32 and 34. Such folding also brings the side edges 22 and 24 of main body member 12 to positions generally adjacent to but rearward of respective ones of the lateral extremities 32 and 34 of the forward face. However, while the side edges 22 and 24 are disposed generally adjacent the lateral extremities of the forward face, they do extend slightly laterally beyond such extremities, as best seen in FIGS. 2 and 4 due to the amount of spacing of the tab members 28 and 30 from the side edges 22 and 24.

It can also be seen that the above method of folding brings the tab members 26, 28 and 30 into overlying relationship to form the tab assembly 14. Specifically, each of the side tab members 28 and 30 is doubled upon itself and then placed behind a respective side of the central tab member 26. Thus, the tab assembly 14 will include three thicknesses of fabric, or other sheet material, throughout. This stiffens or reinforces the tab assembly 14 so that it resists becoming dislodged when tucked behind the belt, waistband, etc. of the user.

Figure 5:
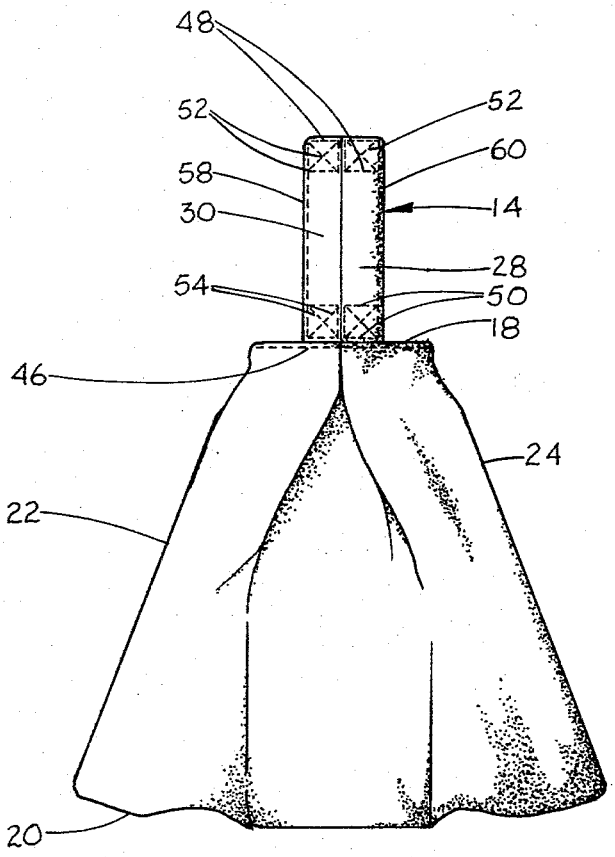
FIG. 5 is a rear elevational view of the towel of FIGS. 2–4 with the tab assembly raised and the main body member opened out.

After folding, the towel material is secured by stitching or otherwise fastening the tab members in the aforementioned overlying relation, and also stitching or otherwise fastening the main body member 12 in its box pleated configuration adjacent the upper edge 18. In particular, to form a towel assembly according to FIGS. 2–5, the main body member is stitched transversely thereacross just below upper edge 18 along the line 46 (see FIG. 5). The lower end portion of the main body member 12 adjacent the lower edge 20 remains free so that the main body member may be opened out for use (as also shown in FIG. 5). However, the stitching 46 along the upper end portion adjacent upper edge 18 assures that the main body member will resume its folded configuration when released as shown in FIGS. 1 and 2.

The tab members are secured together by stitching transversely thereacross in longitudinally spaced locations. Such stitching includes a first pair of parallel stitching lines 48 adjacent the upper end of the tab assembly, with diagonal stitching lines 52 extending therebetween. Longitudinally spaced from stitching lines 48, i.e. at the lower end of tab assembly 14, are a second pair of transverse parallel stitching lines 50 interconnected by diagonal stitching lines 54. Diagonal stitching 52 and 54 serves to further stiffen the tab assembly 14. Due to the longitudinal spacing between stitching lines 48 and stitching lines 50, there is formed a transverse passageway 56 (FIG. 3) between the forward tab member 26 and the tab members 28 and 30 disposed rearwardly thereof. Passageway 56 may be used as a belt loop to provide an alternative means of securing the towel on the person of the user. Preferably, the edges of each of the side tab members 28 and 30 are stitched together along lines 58 and 60, shown in FIG. 5, after the side sections have been folded along lines 42 and 44 but before the tab members have been placed in overlying relation by folding along lines 32 and 34. This provides a more finished tab assembly and eliminates the laterally opening blind pockets which would otherwise be formed by folded tab members 28 and 30.

Figure 6:
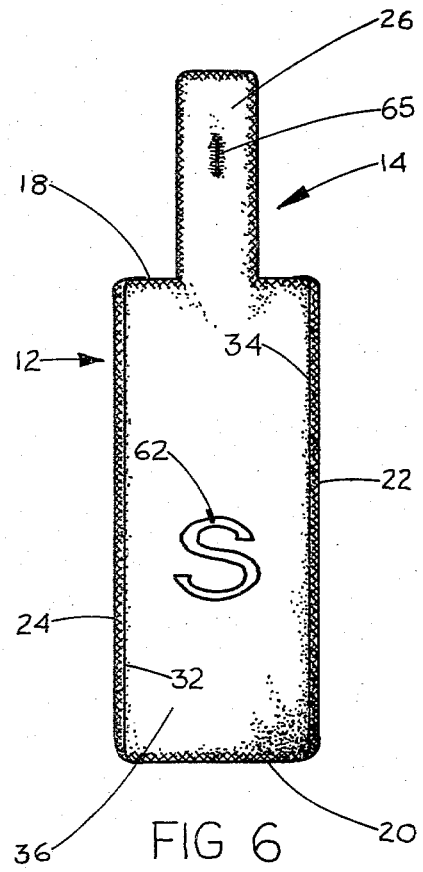
FIG. 6 is a front elevational view of a second embodiment of the invention with the tab assembly raised.

Referring now to FIG. 6, there is shown an alternative embodiment of the invention. This embodiment is cut and folded in precisely the same manner as the embodiment of FIGS. 2–5, and in particular, in accord with FIGS. 7 and 8. The main difference between the embodiment of FIG. 6 and that of FIGS. 2–5 is in the manner of securing the material in its folded configuration. Accordingly, like parts of the two embodiments have been given like reference numerals. In forming the towel of FIG. 6, after cutting and folding the towel blank in the manner described hereinabove, the folded blank is stitched by overcasting along the entire peripheral edge thereof as shown at 64. As previously noted, when the towel blank is properly folded, the side edges 22 and 24 of the main body member 12 extend slightly laterally outwardly of the lateral extremities of the uninterrupted forward face, i.e. the fold lines 34 and 32. This places the side edges within easy sight and reach of the user so that the main body member 12 can be opened out quickly and easily for use. However, such lateral extension also permits the aforementioned overcasting along the side edges 24 and 22 when the towel blank is folded without securing such side edges to the fold lines 32 and 34. The overcasting process is further facilitated by the rounded configuration of the corners of the towel blank.

Overcasting of the folded towel blank as illustrated in FIG. 6 permits a number of different functions to be performed in one relatively simple and inexpensive step. In particular, the overcasting, if done in a color contrasting to that of the towel blank, provides an attractive border trim around the entire periphery of the towel. Such overcasting also serves to prevent ravelling or fraying of the raw edges of the material from which the towel is formed. Finally, since the overcasting extends along upper edge 18 of main body member 12 and also along the side and upper edges of tab assembly 14, such overcasting serves to secure the tab assembly together as well as to secure the upper end portion of main body member 12 in its pleated configuration. Similar results can be achieved by the application of other types of border trim, for example, piping. As an alternative means of securing the towel on the user's person, a buttonhole 65 is provided near the top of tab assembly 14.

As previously explained, and as illustrated in FIGS. 1, 2 and 6, the folding and stitching of the main body member 12 causes it to automatically fall into a flat, neatly folded configuration of relatively narrow lateral dimension when it is suspended from the user's waist by the tab assembly 14. This not only keeps the towel out of the user's way when he is not actively utilizing it, but also maintains a neat appearance by presenting the substantially rectangular uninterrupted forward face 36, which may be framed by the laterally extending side edges 22 and 24. Thus, the towel of the invention not only does not detract from the player's appearance, but may actually enhance it, particularly if the forward face 36 has a suitable decorative symbol or logo 62 applied thereto. The fact that the side edges 22 and 24 are disposed adjacent the lateral extremities 32 and 34 of the forward face 36 makes it particularly easy for the player to open out the main body member 12 for use even during a fast moving sport. This is especially true where the side edges extend slightly laterally beyond the lateral extremities of the forward face. Yet, due to the stitching of the pleated main body member 12 adjacent the upper edge 18, the main body member will always resume the configuration shown in FIG. 1 when released by the player.

The stiffened or reinforced tab assembly 14 provides an especially effective way of securing the towel on the user's person. Experience has shown that, even though the tab assembly 14 is merely tucked behind the player's belt or the waistband of his trousers, the towel will ordinarily not become dislodged, even in the course of such a rough and active sport as football. Nevertheless, this method of securing the towel on the user's person permits the towel to be quickly and easily removed from the vicinity of his waist, for example, so that he may wipe his face or neck, and to be returned to a waist-suspended position just as quickly and easily. However, as illustrated in the embodiment of FIGS. 2–5, the towel of the invention may be easily adapted to provide an alternative and more permanent manner of securing on the user's person, e.g. a belt loop.

While the invention has been described above primarily in connection with its potential use by athletes, it will be readily apparent that its numerous advantages make it suitable for many other uses. For example, it might be worn as an accessory by sporting fans. The invention could also be advantageously used by persons such as restaurant personnel who frequently require the use of a towel in their line of work.

It will also be apparent that many modifications of the preferred embodiment described above can be made without departing from the spirit of the invention. For example, in the embodiments described above the several tab members in the original towel blank are laterally spaced from each other as well as from the side edges of the main body member. Thus, the completed tab assembly is narrower than the forward face of the main body member, and there is a well defined upper edge to the main body member. However, in some embodiments it may be desirable to provide a tab assembly of substantially the same width as the folded main body member therebelow. In such instances, the original towel blank may be in the form of a simple rectangle, the tab member merely being an extension of the main body member. However, while the latter embodiment may not include a clearly defined upper edge of the main body member, a towel according to the invention can, in any event, be said to include an upper end portion, being that portion adjacent the tab assembly or the part of the blank which is intended to be formed into the tab assembly. The main body member would also be said to have a lower end portion adjacent the lower edge thereof.

Other modifications might involve changes in the method of forming the towel. For example, in the exemplary method disclosed herein the towel blank was cut prior to folding and stitching. However, it will be apparent that the sheet material could first be folded in the form of a box pleat, then stitched in an appropriate manner, and finally, the excess material trimmed away outwardly of such stitching. Accordingly, it is not intended that the order in which the various steps are recited in the appended claims be construed as limiting the actual order of performance, in the absence of specific language so indicating.

Another possible modification of the present invention would be to form the main body member and tab assembly as separate pieces and then secure them together so that the tab assembly would integrally depend from the stitched or secured end portion of the main body member. Other modifications might involve changes in the manner of stitching or otherwise securing the folded sheet material.

Still other variations will suggest themselves to those of skill in the art. Accordingly, it is intended that the scope of the present invention be limited only by the claims which follow.

We claim:

1. A method of forming a towel including:

cutting a sheet of absorbent flexible material to form a main body member including a pair of opposite end portions and a pair of opposite side edges extending generally transversely to said end portions, and a plurality of tab members extending from one of said end portions generally parallel to each other;

folding the sheet material of said main body member upon itself in a single box pleat to form an uninterrupted forward face and to position each of said edges generally adjacent to and rearwardly of a respective one of the lateral extremities of said forward face, said folding also placing, said tab members in overlying relation to one another;

securing said folded sheet material of said main body upon itself adjacent said one end portion; and securing said overlying tab members to one another to form a tab assembly.

2. The method of claim 1 wherein said securing includes stitching transversely across said one end portion.

3. The method of claim 1 wherein a first of said tab members is formed to extend from said forward face, wherein a second of said tab members is formed in spaced relation from said first tab member and from a first one of said side edges, wherein a third one of said tab members is formed in spaced relation from said first tab member and from the other of said side edges, wherein each of said second and third tab members is folded upon itself along a respective folding line common to said box pleat of said main body member, and wherein each such folded tab member is disposed rearwardly of a respective side of said first tab member by the folding of sad box pleat.

4. The method of claim 1 wherein said juxtaposed tab members are secured to one another in longitudinally spaced locations to form a transverse passageway between said tab members.

5. The method of claim 1 wherein said securing of said main body member and said tab assembly includes stitching along the outer periphery of said tab assembly and said folded main body member.

6. The method of claim 5 wherein said side edges of said main body member are disposed laterally outwardly of the respective lateral extremities of said forward face, and wherein said stitching comprises applying a border trim along the entirety of the outer periphery of said towel.

7. The method of claim 1 wherein said side edges of said main body member are disposed laterally outwardly of the respective lateral extremities of said forward face.

8. A towel comprised of flexible absorbent sheet material and including:

a main body member having a pair of opposite end portions and a pair of opposite side edges extending generally transversely to said end portions, the sheet material of said main body member being folded upon itself in a single box pleat to form an uninterrupted forward face and to position each of said side edges generally adjacent to and rearwardly of a respective one of the lateral extremities of said forward face, said sheet material of said main body member further being secured upon itself in said folded configuration adjacent one of said end portions; and a tab assembly integrally extending from said one end portion and comprising a plurality of tab members disposed in overlying relationship to one another and secured to one another.

9. A towel according to claim 8 wherein said box pleat is secured by stitching extending transversely across said one end portion.

10. A towel according to claim 8 wherein said tab members include a first tab member extending from said forward face, a second tab member spaced along said one end portion from said first tab member and from a first one of said side edges, and a third tab member spaced along said one end portion from said first tab member and from the other of said side edges, and wherein each of said second and third tab members is folded upon itself along a respective folding line common to said box pleat of said main body member, and each such folded tab member is disposed rearwardly of a respected side of said first tab member by the folding of said box pleat.

11. A towel according to the claim 8 wherein said overlying tab members are secured to one another in longitudinally spaced locations to form a transverse passageway between said tab members.

12. A towel according to claim 8 wherein said tab assembly and said main body member are secured by stitching extending along the outer periphery of said tab assembly and said main body member.

13. A towel according to claim 8 wherein said side edges of said main body member are disposed laterally outwardly of the respective lateral extremities of said forward face and further comprising a border trim extending along the entire outer periphery of said towel, said border trim further serving to secure said tab members to one another and to secure said main body member in said folded configuration.

14. A towel according to claim 8 wherein said side edges of said main body member are disposed laterally outwardly of the respective lateral extremities of said forward face.

* * * * *